US012173987B2

(12) United States Patent
Enzinger

(10) Patent No.: US 12,173,987 B2
(45) Date of Patent: Dec. 24, 2024

(54) TOOL-LESS RE-ZERO ADJUSTMENT KNOB FOR AIMING DEVICES, AND METHODS OF ZEROING AN AIMING DEVICE

(71) Applicant: Leupold & Stevens, Inc., Beaverton, OR (US)

(72) Inventor: Kyle Edward Enzinger, Newberg, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 0 days.

(21) Appl. No.: 18/405,945

(22) Filed: Jan. 5, 2024

(65) Prior Publication Data

US 2024/0219146 A1 Jul. 4, 2024

Related U.S. Application Data

(60) Division of application No. 17/650,247, filed on Feb. 7, 2022, now Pat. No. 11,906,268, which is a continuation-in-part of application No. 16/803,881, filed on Feb. 27, 2020, now Pat. No. 11,243,049.

(60) Provisional application No. 62/811,022, filed on Feb. 27, 2019.

(51) Int. Cl.
*F41G 1/38* (2006.01)

(52) U.S. Cl.
CPC ..... *F41G 1/38* (2013.01)

(58) Field of Classification Search
CPC .... G02B 23/16; G02B 23/2476; G02B 26/08; G02B 26/0833; G02B 27/00; G02B 27/36; G02B 27/0056; F41G 1/38; F41G 1/42

See application file for complete search history.

(56) References Cited

U.S. PATENT DOCUMENTS

| | | | |
|---|---|---|---|
| 3,095,750 | A | 7/1963 | Mahn |
| 3,280,463 | A | 10/1966 | Stadler |
| 3,990,155 | A | 11/1976 | Akin, Jr. et al. |
| 4,012,966 | A | 3/1977 | Lieberman et al. |
| 4,038,757 | A | 8/1977 | Hicks et al. |
| 4,200,355 | A | 4/1980 | Williams, Jr. |
| 4,247,161 | A | 1/1981 | Unertl, Jr. |
| 4,285,137 | A | 8/1981 | Jennie |
| 4,373,269 | A | 2/1983 | Doliber et al. |

(Continued)

FOREIGN PATENT DOCUMENTS

| | | | |
|---|---|---|---|
| WO | 2020064762 | A1 | 4/2020 |
| WO | 2022010625 | A2 | 1/2022 |

*Primary Examiner* — Michael D David

(74) *Attorney, Agent, or Firm* — Schwabe, Williamson & Wyatt, P.C.

(57) ABSTRACT

User-zeroable adjustment knobs for an aiming device include a rotating member that is rotated to change a setting of the aiming device, a dial selectively couplable to the rotating member via a clutch for co-rotation therewith, and a locking mechanism that prevents the dial and rotating member from rotating relative to the aiming device when the locking mechanism is locked. The clutch is disengageable without the use of tools to allow the dial to rotate relative to the rotating member for zeroing the aiming device. The locking mechanism may include a lock release that is accessible from outside of the dial and movable relative to the dial and the rotating member to release the locking mechanism. Methods of zeroing locking adjustment knobs are also disclosed.

20 Claims, 13 Drawing Sheets

(56) References Cited

U.S. PATENT DOCUMENTS

| | | | |
|---|---|---|---|
| 4,643,542 | A | 2/1987 | Gibson |
| 4,789,231 | A | 12/1988 | Shimizu |
| 5,499,456 | A | 3/1996 | Tomita |
| 5,513,440 | A | 5/1996 | Murg |
| 5,615,487 | A | 4/1997 | Tomita |
| 6,279,259 | B1 | 8/2001 | Otteman |
| 6,351,907 | B1 | 3/2002 | Otteman |
| 6,519,890 | B1 | 2/2003 | Otteman |
| 6,643,970 | B2 | 11/2003 | Huber |
| 6,691,447 | B1 | 2/2004 | Otteman |
| 7,415,791 | B2 | 8/2008 | Williams, III et al. |
| 7,578,091 | B2 | 8/2009 | Klepp et al. |
| 7,581,346 | B2 | 9/2009 | Klepp et al. |
| 7,612,952 | B2 | 11/2009 | Schäfer |
| 7,626,760 | B2 | 12/2009 | Wu |
| 7,640,830 | B2 | 1/2010 | Bonis |
| 7,827,723 | B1 | 11/2010 | Zaderey et al. |
| 7,913,440 | B2 | 3/2011 | Murg et al. |
| 7,934,335 | B2 | 5/2011 | Halverson |
| 7,958,665 | B2 | 6/2011 | Hamilton |
| 7,997,163 | B2 | 8/2011 | Casas |
| 8,006,429 | B2 | 8/2011 | Windauer |
| 8,104,217 | B2 | 1/2012 | Huber |
| 8,166,696 | B2 | 5/2012 | Hamilton |
| 8,270,104 | B2 | 9/2012 | Windauer |
| 8,312,667 | B2 | 11/2012 | Thomas et al. |
| 8,397,420 | B2 | 3/2013 | Hamilton |
| 8,413,364 | B2 | 4/2013 | Riley |
| 8,448,374 | B2 | 5/2013 | Samson et al. |
| 8,479,402 | B2 | 7/2013 | Schmitt |
| 8,490,317 | B2 | 7/2013 | Adkins et al. |
| 8,516,736 | B2 | 8/2013 | Windauer |
| 8,670,179 | B2 | 3/2014 | Windauer |
| 8,806,798 | B2 | 8/2014 | Crispin |
| 8,848,287 | B2 | 9/2014 | Schmitt et al. |
| 8,875,435 | B2 | 11/2014 | Menges et al. |
| 8,904,696 | B2 | 12/2014 | Geller |
| 8,919,026 | B2 | 12/2014 | Hamilton |
| 8,928,878 | B2 | 1/2015 | Jaeschke et al. |
| 8,984,796 | B2 | 3/2015 | Thomas et al. |
| 9,046,913 | B2 | 6/2015 | Crispin |
| 9,057,586 | B2 | 6/2015 | Wagner et al. |
| 9,062,934 | B1 | 6/2015 | Presley et al. |
| 9,170,068 | B2 | 10/2015 | Crispin |
| 9,182,773 | B2 | 11/2015 | Campean |
| 9,188,408 | B2 | 11/2015 | Huynh |
| 9,292,034 | B2 | 3/2016 | Windauer |
| RE46,011 | E | 5/2016 | Huber |
| 9,354,438 | B2 | 5/2016 | Ingenito et al. |
| 9,423,215 | B2 | 8/2016 | White et al. |
| 9,435,609 | B2 | 9/2016 | Hamilton |
| 9,488,825 | B2 | 11/2016 | Sigmund |
| 9,665,120 | B2 | 5/2017 | Windauer |
| 9,677,848 | B2 | 6/2017 | Hamilton |
| 9,753,483 | B1 | 9/2017 | Thomas et al. |
| 9,835,819 | B2 | 12/2017 | Tang |
| 9,958,235 | B2 | 5/2018 | Lassak et al. |
| 9,958,666 | B2 | 5/2018 | Ingenito |
| 9,970,735 | B2 | 5/2018 | Walker |
| 9,989,362 | B2 | 6/2018 | Öttl et al. |
| 10,012,476 | B2 | 7/2018 | Öttl |
| 10,054,398 | B2 | 8/2018 | White et al. |
| 10,101,122 | B2 | 10/2018 | Davidson et al. |
| 10,132,593 | B2 | 11/2018 | White et al. |
| 10,145,651 | B2 | 12/2018 | Cheng |
| 10,180,698 | B2 | 1/2019 | Tsai et al. |
| 10,190,848 | B2 | 1/2019 | VanBecelaere |
| 10,190,849 | B1 | 1/2019 | Webber |
| 10,197,360 | B2 | 2/2019 | White et al. |
| 10,234,239 | B1 | 3/2019 | Webber |
| 10,241,318 | B2 | 3/2019 | Takahashi et al. |
| 10,302,394 | B2 | 5/2019 | Ding et al. |
| 10,309,749 | B2 | 6/2019 | Hamilton |
| 10,330,438 | B2 | 6/2019 | Schmidt |
| 10,345,079 | B2 | 7/2019 | Geller |
| 10,365,100 | B2 | 7/2019 | Öttl et al. |
| 10,443,979 | B2 | 10/2019 | Sheets, Jr. et al. |
| 10,466,735 | B2 | 11/2019 | Tsai et al. |
| 10,495,415 | B2 | 12/2019 | Chou et al. |
| 10,578,399 | B2 | 3/2020 | Crispin |
| 10,591,253 | B1 | 3/2020 | Webber |
| 10,655,935 | B1 | 5/2020 | White et al. |
| 10,690,445 | B2 | 6/2020 | Hamilton |
| 10,724,828 | B2 | 7/2020 | Hamilton |
| 10,724,829 | B1 | 7/2020 | Ding et al. |
| 10,830,561 | B2 | 11/2020 | Davidson et al. |
| 10,866,064 | B2 | 12/2020 | Weiszl |
| 10,900,747 | B2 | 1/2021 | Kilic |
| 10,907,933 | B1 | 2/2021 | Hamm et al. |
| 10,921,576 | B2 | 2/2021 | Weiszl |
| 10,962,328 | B2 | 3/2021 | Hamiton |
| 11,105,587 | B2 | 8/2021 | Hamilton et al. |
| 11,156,435 | B2 | 10/2021 | Hamilton |
| 11,248,876 | B2 | 2/2022 | Davis et al. |
| 11,255,636 | B2 | 2/2022 | Crispin |
| 11,320,241 | B2 | 5/2022 | Hamilton et al. |
| 11,353,289 | B2 | 6/2022 | Walker et al. |
| 11,372,228 | B1 | 6/2022 | Davis et al. |
| 11,372,229 | B2 | 6/2022 | Xiong et al. |
| 11,530,899 | B2 | 12/2022 | Sheets, Jr. |
| 2007/0240356 | A1 | 10/2007 | Klepp et al. |
| 2008/0066364 | A1 | 3/2008 | Klepp et al. |
| 2010/0175298 | A1 | 7/2010 | Thomas et al. |
| 2011/0100152 | A1* | 5/2011 | Huynh ..... F41G 1/22 74/504 |
| 2011/0261449 | A1 | 10/2011 | Schmitt |
| 2014/0137458 | A1 | 5/2014 | Crispin |
| 2014/0237884 | A1 | 8/2014 | Koesler et al. |
| 2016/0040959 | A1 | 2/2016 | Davidson et al. |
| 2017/0226806 | A1 | 8/2017 | Nguyen |
| 2019/0128642 | A1 | 5/2019 | Davis et al. |
| 2020/0278179 | A1 | 9/2020 | Ding et al. |
| 2020/0326155 | A1 | 10/2020 | Hamilton et al. |
| 2021/0302127 | A1 | 9/2021 | Mueller |
| 2021/0325147 | A1 | 10/2021 | Gruner et al. |
| 2021/0389553 | A1 | 12/2021 | Campbell et al. |
| 2021/0396492 | A1 | 12/2021 | Hamilton et al. |
| 2022/0042768 | A1 | 2/2022 | Hamilton |
| 2022/0136803 | A1 | 5/2022 | Davis et al. |
| 2022/0170717 | A1 | 6/2022 | Crispin |
| 2022/0229281 | A1 | 7/2022 | Sakai et al. |
| 2022/0244521 | A1 | 8/2022 | Liang |
| 2022/0373296 | A1 | 11/2022 | Cheng |
| 2022/0390736 | A1 | 12/2022 | Chang |
| 2022/0413278 | A1 | 12/2022 | Cheng |
| 2023/0134361 | A1* | 5/2023 | Enzinger ..... F41G 1/38 42/122 |

* cited by examiner

204

204

TOOL-LESS RE-ZERO ADJUSTMENT KNOB FOR AIMING DEVICES, AND METHODS OF ZEROING AN AIMING DEVICE

RELATED APPLICATIONS

This application is a divisional of U.S. patent application Ser. No. 17/650,247, filed Feb. 7, 2022, which is a continuation-in-part under 35 U.S.C. § 120 of U.S. patent application Ser. No. 16/803,881, filed Feb. 27, 2020, now U.S. Pat. No. 11,243,049, which claims the benefit under 35 U.S.C. § 119(e) of U.S. Provisional Patent Application No. 62/811,022, filed Feb. 27, 2019, each of which are herein incorporated by reference in their entirety.

TECHNICAL FIELD

The present disclosure generally relates to aiming devices such as rifle scopes and other weapon aiming devices, and more particularly, adjustment turret knobs for aiming devices that can be re-zeroed without the use of tools, and to aiming devices including such adjustment knobs.

BACKGROUND

An optical aiming scope for a projectile weapon such as a firearm may require adjustment when targeted on an object. For example, because a bullet may fall or otherwise have its course changed by environmental factors as it travels, the aim of the scope may be adjusted vertically and/or horizontally to compensate for such effects and increase the likelihood that an object located in crosshairs of the scope will be impacted by the bullet. Vertical adjustment of the scope's aim is known as elevation adjustment because it compensates for a bullet's elevation change (e.g., falling), and horizontal adjustment of the scope's aim is known as windage adjustment because it compensates for sideways movement of a bullet, which is often caused by wind.

The horizontal and vertical adjustment of the aim can be accomplished by manually rotating turret knobs on the scope that adjust the position of lenses or other optical elements inside the scope. An indicator scale comprising a set of markings on the outside of the knob provides a visual indication of the amount of rotation of the knob. In some adjustment knobs, the position of the indicator scale can be adjusted relative to the setting of the knob by using a hex key to loosen a grub screw coupling a dial of the knob to a rotatable threaded member inside of the knob, as is taught for example in patent No. U.S. Pat. No. 9,170,068 of Crispin, which is incorporated herein by reference. After the grub screw is loosened, the dial can be rotated to the desired position to adjust a zero setting of the knob, then the grub screw is re-tightened to fix the dial to the threaded member for co-rotation. By "zeroing" the elevation and/or windage knob in this manner, the shooter may ensure that the scope is properly calibrated (or "sighted-in") for aiming the firearm at an object at a particular distance. Sighting-in a riflescope at a known distance facilitates accurate aiming adjustments for other distances or environmental conditions, relative to the calibrated setting.

Patent Nos. U.S. Pat. No. 6,279,259 of Otteman and U.S. Pat. No. 5,513,440 of Murg disclose riflescope adjustment mechanisms that can be re-zeroed without the use of tools. In each case, a dial portion of the adjustment mechanism is movable axially relative to inner threaded member. When the dial portion is pushed axially inward into engagement with the threaded member, the dial and threaded member rotate together to accomplish aiming adjustments. When the dial portion is pulled axially outward it can be rotated relative to the threaded member to re-set a zero setting of an indicator scale of the adjustment mechanism.

The present inventor has recognized the need for improved systems and methods for re-zeroing optical scope adjustment mechanisms.

Additional aspects and advantages will be apparent from the following detailed description of preferred embodiments, which proceeds with reference to the accompanying drawings.

BRIEF DESCRIPTION OF THE DRAWINGS

FIG. 6A shows the elevation adjustment knob in an engaged position and the windage adjustment knob in a disengaged position, and FIG. 6B shows the opposite situation.

DETAILED DESCRIPTION OF PREFERRED EMBODIMENTS

Figure 1:
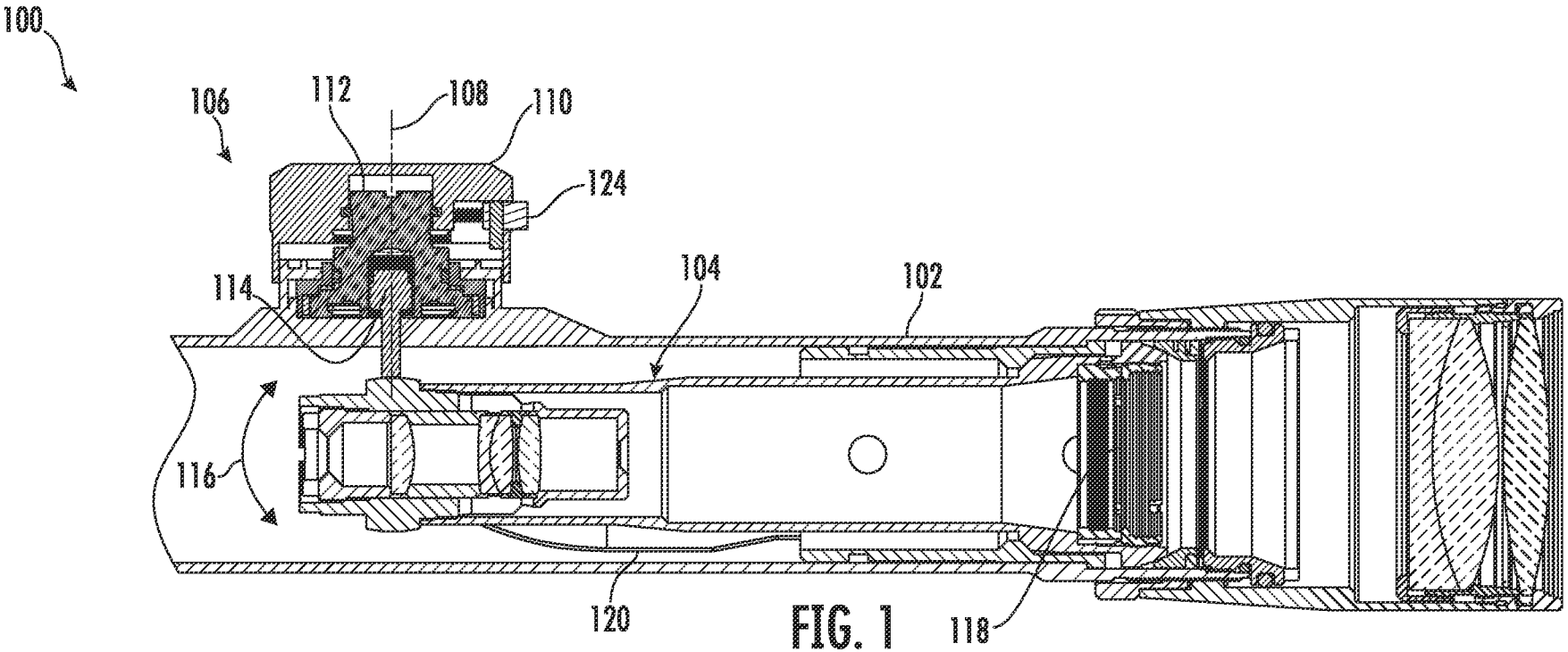
FIG. 1 is a partial cross-sectional view of a riflescope along a longitudinal axis showing an adjustment knob in a disengaged position.

FIG. 1 Illustrates a cross-sectional view of a riflescope 100 along a longitudinal axis having a housing 102 (sometimes referred to as the "maintube") and an image-inverting erector system 104 pivotably mounted within the housing 102, where erector system 104 provides an image of a point of aim. An adjustment knob 106 protrudes from housing 102 and is rotatable about an axis 108 extending transversely to a longitudinal axis of the housing 102. In some embodiments, adjustment knob 106 is press fit onto housing 102. In other embodiments, adjustment knob is threaded onto housing 102. Although a presently preferred embodiment of a weapon aiming device is described herein as riflescope 100, adjustment knobs consistent with the present disclosure may also be used with other types of optical aiming devices, such as red-dot sights, reflex sights, holographic aiming sights, iron sights, and other devices for aiming weapons and other devices, and particularly those devices for which a user may wish to adjust a zero or home position of the aiming device.

Figure 2:
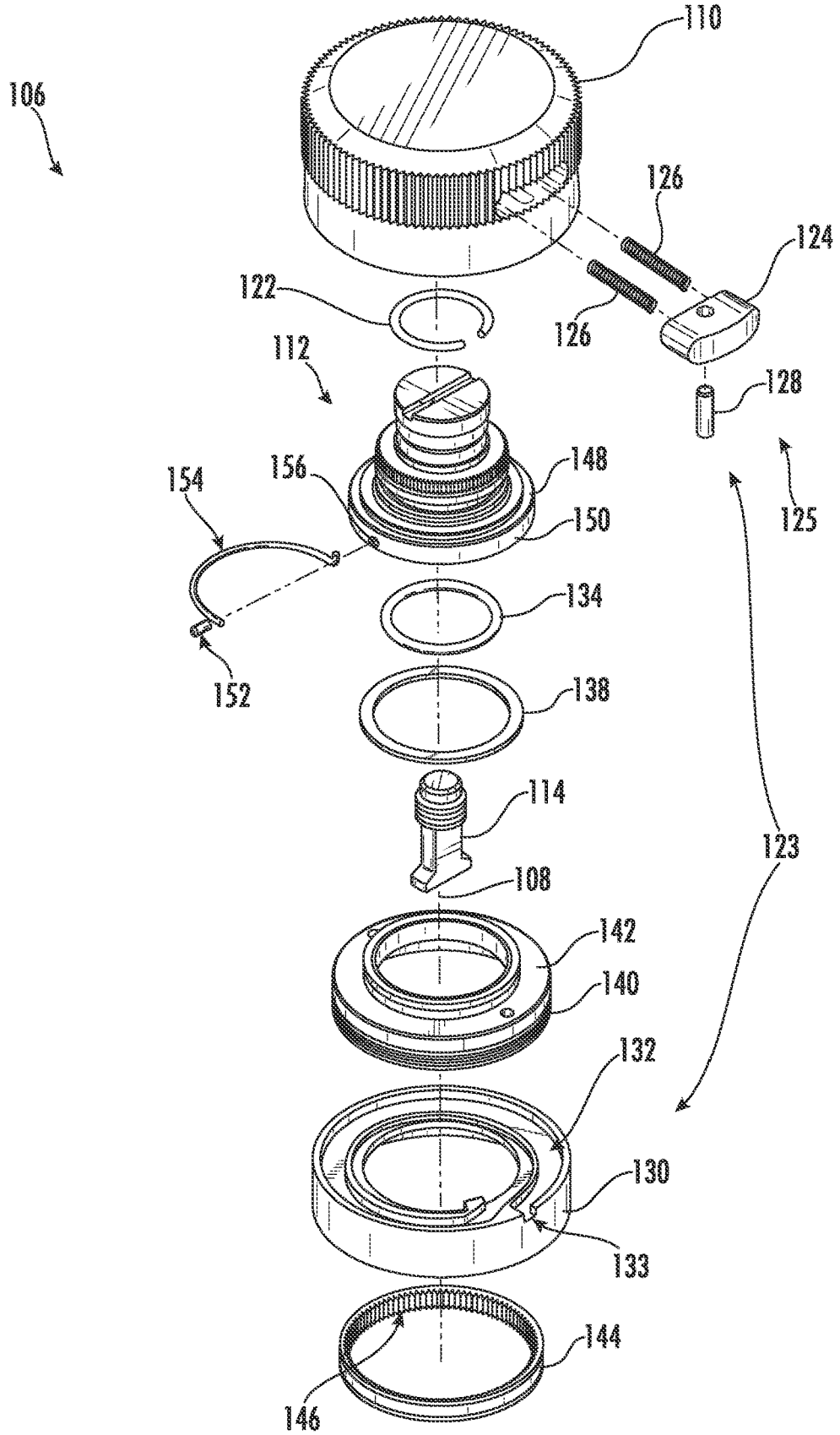
FIG. 2 is an exploded isometric view of the adjustment knob of FIG. 1.
Figure 3:
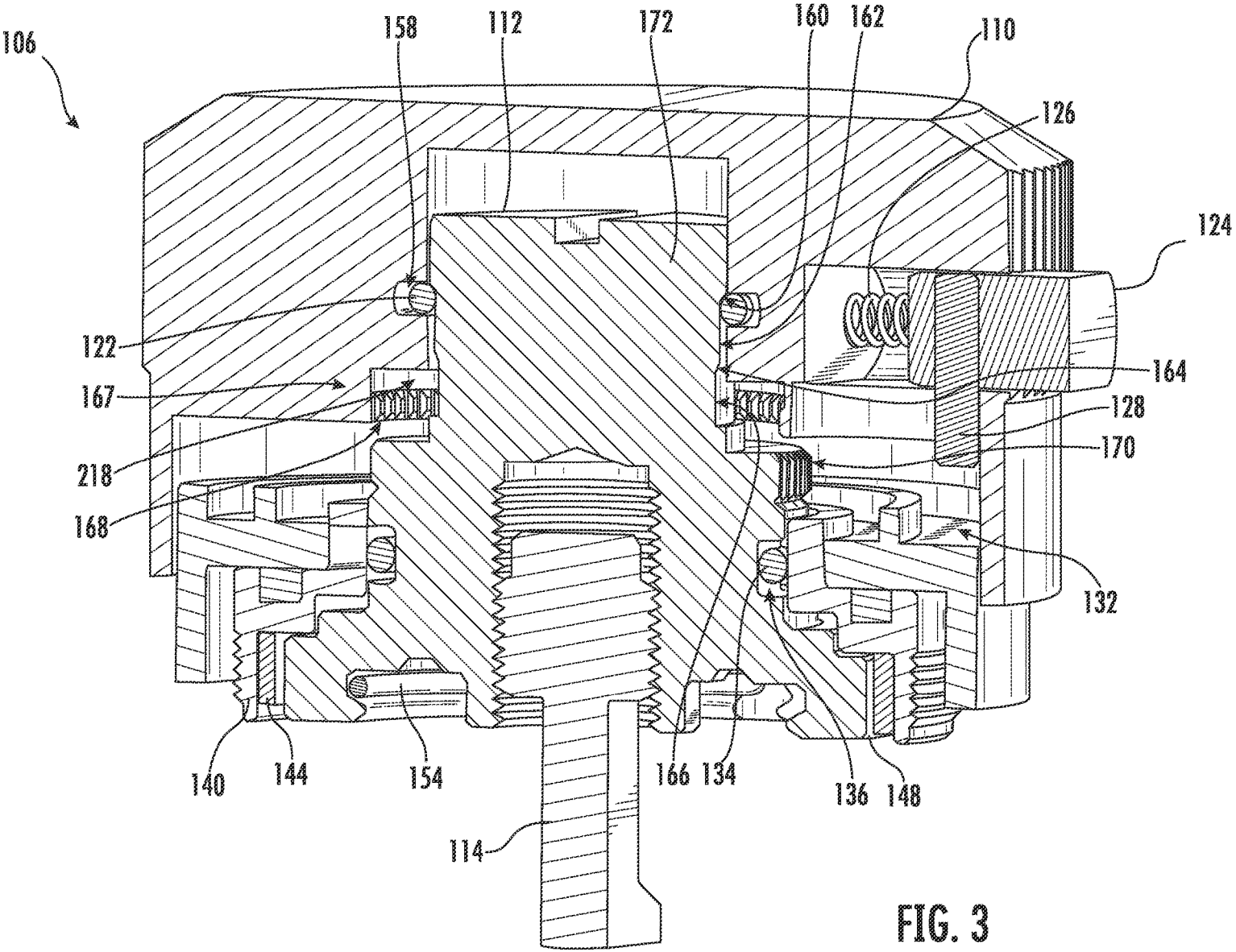
FIG. 3 is an enlarged isometric cross-sectional view of the adjustment knob of FIG. 1 showing a dial of the knob disengaged from a rotating member of the knob.
Figure 5:
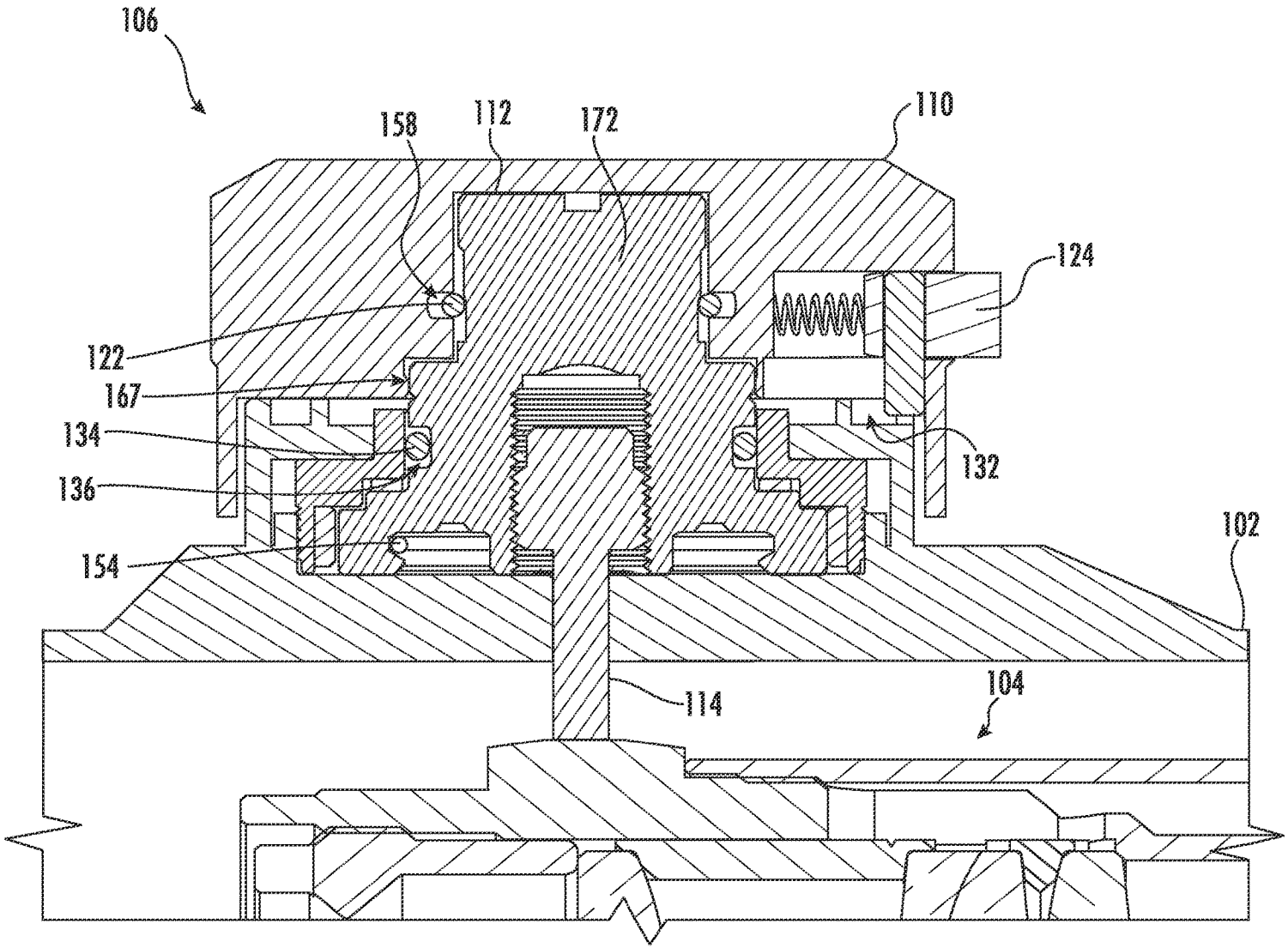
FIG. 5 is an enlarged cross-sectional view of the riflescope and adjustment knob of FIG. 1 showing the dial engaged with the rotating member.

With reference to FIGS. 1-3, in the embodiment shown, adjustment knob 106 includes a dial 110 configured to engage and disengage with a rotating member 112 (which is also rotatable about axis 108). When in an engaged position (as illustrated in FIG. 5), dial 110 is engaged with rotating member 112. When in a disengaged position (as illustrated in FIG. 3), dial 110 is disengaged with rotating member 112. In some embodiments, rotating member 112 may be configured as a rotating adjustment nut or spindle that includes a hub 172. When there is engagement between dial 110 and rotating member 112, a setting of riflescope 100 can be changed. In the example illustrated, an adjustment screw (or threaded plunger) 114 is coupled (e.g., threaded) to an interior threaded cavity of the rotating member 112 and rotationally constrained in a slot in housing 102 so that rotation of dial 110 and rotating member 112 causes responsive movement of adjustment screw 114 along axis 108, and driving pivoting movement of erector system 104, illustrated by arrows 116, which effects a point of aim shift either vertically (elevation) or horizontally (windage) depending on the position of the adjustment knob 106 on the housing 102. In other embodiments (not illustrated), the rotating member 112 may be an externally threaded screw that is threaded into a threaded hole fixed on housing 102, so that the screw moves axially as it rotates to effect changes in the point of aim or other setting of riflescope 100. The shift in the point of aim of riflescope 100 is typically accomplished through cooperation between lenses or other optical elements within erector system 104 and a reticle 118 within housing 102. A spring 120 biases erector system 104 relative to housing 102 to press erector system 104 against screw 114. In FIG. 1, adjustment knob 106 is shown disengaged with rotating member 112. While FIG. 1 shows a single adjustment knob 106, it should be understood that a second adjustment knob (not visible) may be coupled to housing 102 orthogonally relative to adjustment knob 106, where adjustment knob 106 is one of an elevation adjustment knob which effects a point of aim shift vertically or a windage adjustment knob which effects a point of aim shift horizontally and the second adjustment knob is the other of the elevation adjustment knob or windage adjustment knob.

As shown in FIG. 2, adjustment knob 106 includes a retainer device 122. In some embodiments, retainer device 122 is seated in a different groove (explained with respect to FIGS. 3-5) of rotating member 112 depending on when adjustment knob 106 is in the engaged or disengaged position. In some embodiments, retainer device 122 is a spring, such as a spring snap ring, for example, and the ring may encircle rotating member 112 fully or partially. In other embodiments, the retainer device may be omitted, or retention may be accomplished through different structures for features.

In some embodiments, adjustment knob 106 further includes a locking mechanism 123 which may include a lock release 125 and a guideway ring 130. In the embodiment illustrated, lock release 125 comprises a depressible button 124 located on a side of dial 110 and accessible from outside of dial 110. Button 124 includes one or more springs 126 that bias button 124 radially outward and a pin 128, guide tab, or other protrusion, movable with button 124 radially relative to axis 108 when button 124 is pressed and released. The button 124 is movable relative to dial 110 and rotating member 112 to release locking mechanism 123 and allow dial 110 and rotating member 112 to be co-rotated to adjust a setting of riflescope 100. Guideway ring 130 is affixed to housing 102 of riflescope 100, for example by press-fitting guideway ring 130 onto a threaded flange 140 that has been threadably secured to housing 102. In this manner, a channel 132 or other guideway of guideway ring 130 is fixed relative to housing 102. In the embodiment shown, when adjustment knob 106 is in the disengaged position as illustrated in FIG. 3, pin 128 is retracted axially from channel 132 of guideway ring 130, but when adjustment knob 106 is in the engaged position as illustrated in FIG. 5, pin 128 (or guide tab or other protrusion) is received in channel 132 and travels within channel 132 or otherwise rides along the channel 132 or other guideway as dial 110 is rotated. Pin 128 (or guide tab or other protrusion) is biased into a notch 133 (FIG. 2) formed in the guideway of the guideway ring 130 at a zero location of the dial 110 to lock adjustment knob 106 at the zero location, as is described in greater detail in patent No. U.S. Pat. No. 9,170,068, which is incorporated herein by reference. When the button 124 or other lock release 125 is depressed or otherwise actuated, it moves the pin 128 (or other guide tab or protrusion) out of notch 133 to release the locking mechanism 123 and allow the dial 110 to be rotated away from the zero location. In some embodiments, locking mechanism 123 does not lock at any rotational position of dial 110 other than the zero location. In other embodiments locking mechanism 123 may lock at multiple rotational positions of dial 110. In yet other embodiments, locking mechanism 123 may comprise any of various different adjustment knob locking mechanisms, particularly those locking mechanisms including a lock release accessible from outside the dial 110, and/or those including a lock release carried by the dial 110 for rotation therewith about the axis 108, such as lock release button located on a side of the dial 110 that is depressible in a radial direction toward the axis 108 to release the locking mechanism. Locking mechanisms that are lockable electronically or by other means are also envisioned.

In the embodiment shown, an a-ring 134 is seated within a groove 136 of rotating member 112 (shown in FIG. 3), and a washer 138 is seated within a groove 142 of threaded flange 140 (shown in FIG. 2).

In some embodiments, adjustment knob 106 includes a click mechanism to provide tactile and/or audible feedback to the user when adjustment knob 106 is rotated. For example, in the embodiment shown, a click ring 144 is interposed between a shoulder 150 of the lower base portion 148 of rotating member 112 and threaded flange 140. Click ring 144 includes a grooved surface 146 facing rotating member 112. Grooved surface 146 includes regularly spaced apart features, which, for example, include splines or a series of evenly spaced vertical grooves or ridges. Other engagement features may include a series of detents, indentations, apertures, or other suitable features. The click mechanism further includes a click pin 152 with a ramped surface configured to engage the regularly spaced apart features of grooved surface 146. Click pin 152 is housed within a bore 156 in rotating member 112 that has an open end facing grooved surface 146. A spring 154 or other biasing element urges click pin 152 to extend outwardly from within bore 156 and engage grooved surface 146. In operation, rotational movement of adjustment knob 106 about axis 108 causes click pin 152 to move out of contact with one groove and into a neighboring groove, thereby producing a click that is either audible, tactile, or both. Each click may coincide with an adjustment amount to alert the user about the extent of an adjustment being made.

FIG. 3 is an enlarged isometric cross-sectional view of adjustment knob 106 of FIG. 1, showing dial 110 disengaged with rotating member 112 (meaning that rotation of dial 110 will not cause rotation of rotating member 112 or any change to the setting of riflescope 100 by movement of internal optical components within housing 102 or otherwise). In the embodiment shown, a retainer device 122 is at least partially housed by and carried by a retainer groove 158 formed in dial 110 such that retainer device 122 is axially moveable relative to rotating member 112 with dial 110, but is not axially movable relative to dial 110. In some embodiments, retainer groove 158 is sized such that it allows free expansion of retainer device 122 within it.

Figure 4:
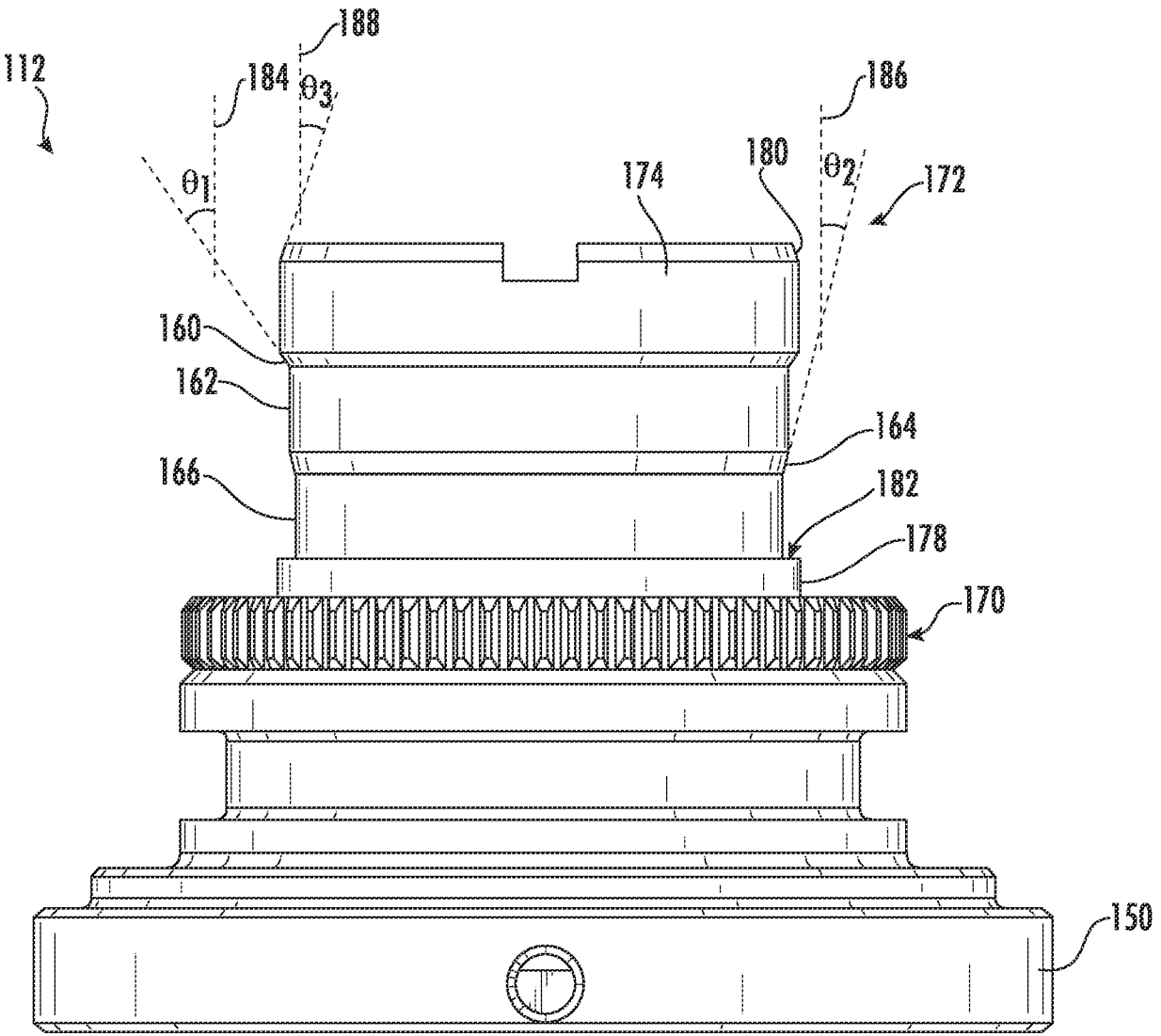
FIG. 4 is an enlarged, isolated side view of the rotating member of FIG. 3 showing details of dial retention features of the rotating member.

With reference to FIG. 3 and FIG. 4, in the embodiment shown, rotating member 112 includes a disengagement ridge 160, a disengagement groove 162, a ridge 164, and an engagement groove 166, where disengagement groove 162 and engagement groove 166 are spaced apart and ridge 164 is formed between grooves 162 and 166. In some embodiments, ridges 160 and 164 and grooves 162 and 166 are formed in hub 172 of rotating member 112. In some embodiments, disengagement groove 162 and engagement groove 166 are spaced apart on hub 172 and ridge 164 is formed between grooves 162 and 166 on hub 172. Items 160-166 are discussed further below. In other embodiments, grooves 162, 166 and ridges 160, 164 may be formed on a shaft, shank, or shoulder of an adjustment screw.

Adjustment knob 106 may include a clutch 167 that selectively couples dial 110 to rotating member 112 for co-rotation. In the embodiment shown, clutch 167 includes a dial clutch surface 168 on dial 110 and a rotating member clutch surface 170 on rotating member 112. Dial 110 is illustrated in FIG. 3 in a disengaged position with dial clutch surface 168 moved axially outward and disengaged from rotating member clutch surface 170. In the disengaged position, the clutch 167 is said to be disengaged or released, whereas in the engaged position the clutch 167 is engaged. In some embodiments, one of dial clutch surface 168 and rotating member clutch surface 170 may have at least one male spline, and the other of dial clutch surface 168 and rotating member clutch surface 170 may have at least one female spline. Either of dial clutch surface 168 and rotating member clutch surface 170 may have male or female splines formed thereon at the same or different pitches. In some embodiments, dial clutch surface 168 may include a spline ring in the form of a plurality of splines that fully or partially encircle an interior cavity 218 of dial 110, and rotating member clutch surface 170 may include a spline ring in the form of a plurality of splines that fully or partially encircle an outer surface of rotating member 112. In some embodiments, dial clutch surface 168 and rotating member clutch surface 170 have the same number of splines, while in other embodiments, dial clutch surface 168 and/or rotating member clutch surface 170 have a different number of splines or no splines at all. It should be noted that dial clutch surface 168 and rotating member clutch surface 170 need not have the same arrangement of splines. For example, one of dial clutch surface 168 and rotating member clutch surface 170 may include one or more splines arranged such that the splines fully encircle interior cavity 218 or an outer surface of rotating member 112, while the other of dial clutch surface 168 and rotating member clutch surface 170 may include only a single spline or a plurality of splines that only partially encircle interior cavity 218 or an outer surface of rotating member 112. It should be noted that dial clutch surface 168 and rotating member clutch surface 170 need not use the same type of engaging components. For example, one of dial clutch surface 168 and rotating member clutch surface 170 may include one or more splines, while the other of dial clutch surface 168 and rotating member clutch surface 170 may include one or more keys or one or more ridges. In another example (not illustrated), dial clutch surface 168 and rotating member clutch surface 170 may each have at least one tooth and form a Hirth joint when dial clutch surface 168 and rotating member clutch surface 170 are engaged. Alternative push-button style clutches are described below with reference to FIGS. 7-13. Many other designs for clutches are also envisioned, including conical clutches, plate clutches, rotary-actuated clutches, electronically actuated clutches, etc.

In some embodiments (not illustrated), the splines of dial clutch surface 168 or rotating member clutch surface 170 may be axially elongated so they can be used both as an element of clutch 167 and as a detent ring for the click mechanism of adjustment knob 106, eliminating the need for a separate detent ring 144.

With reference to FIG. 3, dial 110 is illustrated in a disengaged position, where retainer device 122 is seated in disengagement groove 162, abutting disengagement ridge 160, and substantially housed by retainer groove 158. It should be noted that dial 110 may also be in a disengagement position when retainer device 122 is seated in disengagement groove 162 but not abutting disengagement ridge 160.

With reference to FIGS. 3-5, in the embodiment shown, dial 110 is moveable to an engaged position by pushing dial 110 toward housing 102 (FIGS. 1 and 5) such that retainer device 122 moves over ridge 164 to engagement groove 166 and dial 110 is in an engaged position having dial clutch surface 168 and rotating member clutch surface 170 engaged with each other. FIG. 5 is an enlarged cross-sectional view of adjustment knob 106 showing dial 110 in the engaged position. In the engaged position, rotation of dial 110 will rotate rotating member 112 and change a setting of riflescope 100, e.g., by moving erector system 104 within housing 102.

In some embodiments, when retainer device 122 is seated in the disengagement groove 162, retainer device 122 is substantially housed by retainer groove 158. For example, substantially housed means that about 50% or more of a diameter of retainer device 122 is received in retainer groove 158. In some embodiments, when retainer device 122 is seated in the engagement groove 166, retainer device 122 is only partially housed by retainer groove 158. For example, partially housed means that less than about 50% of a diameter of retainer device 122 is housed by retainer groove 158. It should be noted that in some embodiments, retainer device 122 may be partially housed or substantially housed by retainer groove 158 when it is seated in one or both of disengagement groove 162 or engagement groove 166.

In some embodiments, when dial 110 is moved from a disengaged position to an engaged position (and vice versa), retainer device 122 is moved between disengagement groove 162 and engagement groove 166 and rides over a ridge 164 when moving between grooves 162 and 166. In some embodiments, when retainer device 122 moves or rides over ridge 164 when traveling from engagement groove 166 to disengagement groove 162, retainer device 122 expands into retainer groove 158 such that a greater portion of retainer device 122 is housed by retainer groove 158 when retainer device 122 is seated in the disengagement groove 162 relative to when retainer device 122 is seated in the engagement groove 166. In some embodiments, when retainer device 122 moves or rides over ridge 164 when traveling from disengagement groove 162 to engagement groove 166, retainer device 122 collapses out of retainer groove 158 such that a smaller portion of retainer device 122 is housed by retainer groove 158 when retainer device 122 is seated in the engagement groove 166 relative to when retainer device 122 is seated in the disengagement groove 162.

Retainer device 122 can be configured such that it limits or reduces total travel from the engaged position to the disengaged position (and vice-versa). For example, retainer device 122 can apply constant or substantially constant friction to rotating member 112 such that free movement of retainer device 122 is limited or reduced. In some embodiments, the snap ring or other spring of retainer device 122 may be sized and selected to cooperate with ridge 164 for requiring a minimum pull force to move dial 110 from the engaged position to the disengaged position. The minimum pull force can be a value in the range from about 1 lb. to about 10 lbs, or between about 2 lbs. and 10 lbs. Disengagement ridge 160 is preferably sized larger than engagement ridge 164 to require a pull force preferably exceeding 10 lbs., or exceeding 14 lbs., to remove dial 110 from rotating member 112. In some embodiments, the push force required for moving dial 110 from the disengaged position to the engaged position is about 2 lbs. or less or less than about 1 lb.

It should be noted that while FIGS. 1-5 illustrate embodiments where disengagement groove 162 and engagement groove 166 are formed on rotating member 112 and retainer groove 158 is formed on dial 110, embodiments having other configurations are encompassed by this disclosure. For example, in some embodiments, dial 110 may have a plug configured to insert into a receiving cavity formed in hub 172 of rotating member 112, and the plug may have a disengagement groove and an engagement groove formed thereon substantially similar to grooves 162 and 166. In some embodiments, the receiving cavity of hub 172 may have a retainer groove formed therein substantially similar to retainer groove 158. In such embodiments, retainer device 122 may partially or fully encircle the plug. In such embodiments, retainer device 122 is at least partially housed by and carried by the retainer groove of the receiving cavity such that retainer device 122 is axially moveable relative to dial 110 but not axially movable relative to rotating member 112. In still other embodiments, disengagement groove, engagement groove, and retainer device may be omitted, as illustrated in FIGS. 7-13. Retainer device may also be integrally formed with one or both of dial 110 and rotating member 112, or in other components of adjustment knob 106. In other embodiments, retention may be provided by suction or vacuum through the use of an airtight seal between dial 110 and rotating member 112. Such an airtight seal may be accomplished through the use of a precise mechanical fit, or by a-rings or other seals, while a desired range of movement may be provided through the use of a bladder or flexible diaphragm contained within the adjustment knob and in communication with the sealed space between the dial 110 and rotating member 112. To achieve suction or vacuum, the assembly of such a device may involve bleeding off air from the enclosed space through a vent in the side of the dial 110 as the dial 110 is fitted onto rotating member 112, then sealing the vent after the assembly of dial 110 is complete.

FIG. 4 is an enlarged, isolated view of rotating member 112 of adjustment knob 106. As illustrated in FIG. 4 and discussed above, in some embodiments, rotating member 112 includes disengagement ridge 160, disengagement groove 162, ridge 164, and engagement groove 166 formed in a hub 172 of rotating member 112. In some embodiments, hub 172 also includes a top rib 174 and a bottom rib 178. Engagement groove 166 can also be referred to as a first circumferential step, disengagement groove 162 can also be referred to as a second circumferential step, top rib 174 can also be referred to as a third circumferential step, and bottom rib 178 can also be referred to as a fourth circumferential step. For example, the first circumferential step may be formed by a first circumference of rotating member 112 and the second circumferential step may be formed by a second circumference of rotating member 112, wherein the first circumference is less than the second circumference. For example, the third circumferential step may be formed by a third circumference of rotating member 112 and the fourth circumferential step may be formed by a fourth circumference of rotating member 112, wherein the third circumference is greater than the second circumference, and the third circumference is less than the fourth circumference. For example, the third circumference and fourth circumference may be equal. Moreover, in some embodiments, disengagement groove 162 is formed by a first diameter of rotating member 112 and the engagement groove 166 is formed by a second diameter of rotating member 112, where the first diameter is larger than the second diameter such that the engagement groove 166 is deeper than the disengagement groove 162 relative to an outer circumferential surface of hub 172.

Disengagement ridge 160 and ridge 164 can also each be referred to as a chamfer, for example. For example, a top ridge 180 may be formed on top rib 174, and may also be referred to as a chamfer. In some embodiments, one or more of ridges 160, 164, and 180 are sloped or inclined.

In the embodiment shown in FIG. 4, ridge 160 forms a retention angle 81 with a vertical axis 184 around rotating member 112 which is parallel to axis 108 (FIG. 1). Retention angle 81 is sized and chosen to cooperate with retainer device 122 to inhibit dial 110 from being detached from rotating member 112. In some embodiments, angle 81 is about 45 degrees. In some embodiments, angle 81 can range from about 30 degrees to about 60 degrees. In the embodiment shown, ridge 164 forms a retention angle 82 with a vertical axis 186 around rotating member 112 which is parallel to axis 108 (FIG. 1). In some embodiments, angle 82 is about 17 degrees. In some embodiments, angle 82 can range from about 10 degrees to about 30 degrees. In some embodiments, top ridge 180 also forms an angle 83 with a vertical axis 188 around rotating member 112. In some embodiments, angle 83 is about 30 degrees. In some embodiments, angle 83 can range from about 10 degrees to about 45 degrees. In some embodiments, angle 83 is selected such that installation of retainer device 122 on rotating member 112 will limit or avoid or reduce damage on hub 172 and/or retainer device 122 from incidence with a surface of rotating member 112, such as a surface of top rib 174 (which may have the largest diameter of hub 172 that retainer device 122 rides over).

In some embodiments, a distance between ridge 160 and ridge 164, forming a length of disengagement groove 162, is about 0.09 inches. In some embodiments, a distance between ridge 164 and a lip 182 of bottom rib 178, forming a length of engagement groove 166 is about 0.08 inches. In some embodiments, a distance between ridge 160 and top ridge 180, forming a length of top rib 174, is about 0.09 inches. In some embodiments, the length of disengagement groove 162 and engagement groove 166 is selected such that there is enough clearance for pin 128 of button 124 (shown in FIG. 3) to extend into and retract out of a channel 132. In some embodiments, the ratio of lengths between all or a subset of disengagement groove 162, engagement groove 166, and top rib 174 is selected to reduce or limit the overall assembled height of adjustment knob 106 and/or reduce or limit the freedom of movement of adjustment knob 106 to improve ergonomics of engagement and/or disengagement.

Figure 6A:
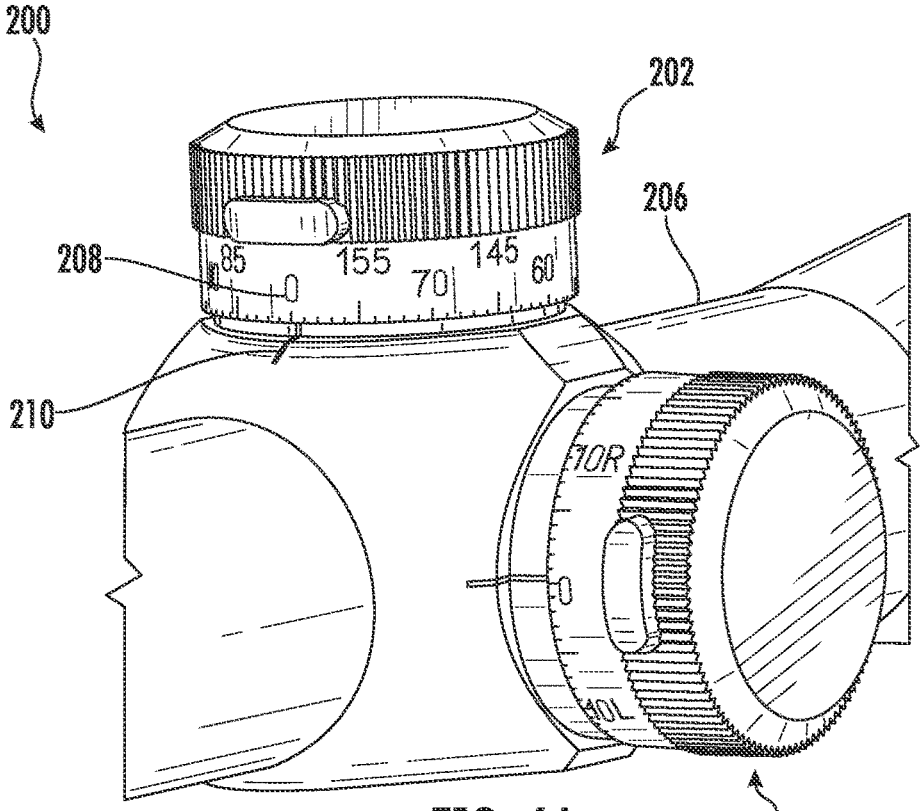
FIGS. 6A and 6B show exterior isometric views of a riflescope having the adjustment knob of FIG. 1 used as an elevation adjustment knob and a windage adjustment knob, where
Figure 6B:
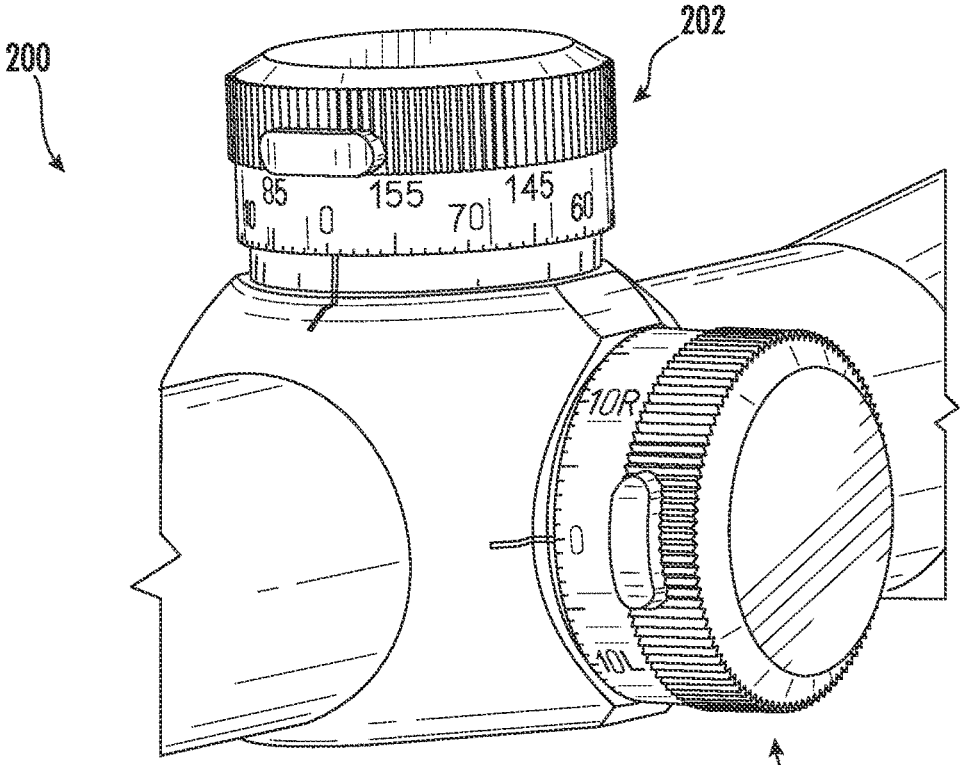

FIG. 6A illustrates a riflescope 200 having adjustment knob 106 used as an elevation knob 202 and a windage knob 204. As shown in FIG. 6A, elevation knob 202 is in an engaged position such that its dial is engaged with a rotating member (112 in FIGS. 1-5) of the elevation knob 202, and windage knob 204 is in a disengaged position such that its dial is disengaged with a rotating member (112 in FIGS. 1-5) of the windage knob 204. A user may have pushed elevation knob 202 toward housing 206 to place elevation knob 202 in its engaged position. In the engaged position, the user may rotate the elevation knob 202 such that optical components of riflescope 200 are adjusted to reflect a particular elevation. The user may then pull elevation knob 202 away from housing 206 to place elevation knob 202 in the disengaged position (as illustrated in FIG. 6B) and then rotate elevation knob 202 until zero mark 208 is aligned with reference mark 210 that is fixed. The user may thereafter push elevation knob 202 back toward housing 206 to place elevation knob 202 in the engaged position, where elevation knob 202 is now zeroed. In FIG. 6A, rotation of windage knob 204 will not cause adjustment of the optical components because windage knob 204 is in a disengaged position. FIG. 6B illustrates an opposite situation to that shown in FIG. 6A where riflescope 200 has elevation knob 202 in a disengaged position and windage knob 204 in an engaged position. When windage knob 204 is in the engaged position illustrated in FIG. 6B, it may be used to adjust optical components of riflescope 200 as discussed above with respect to elevation knob 202 in FIG. 6A.

Figure 11:
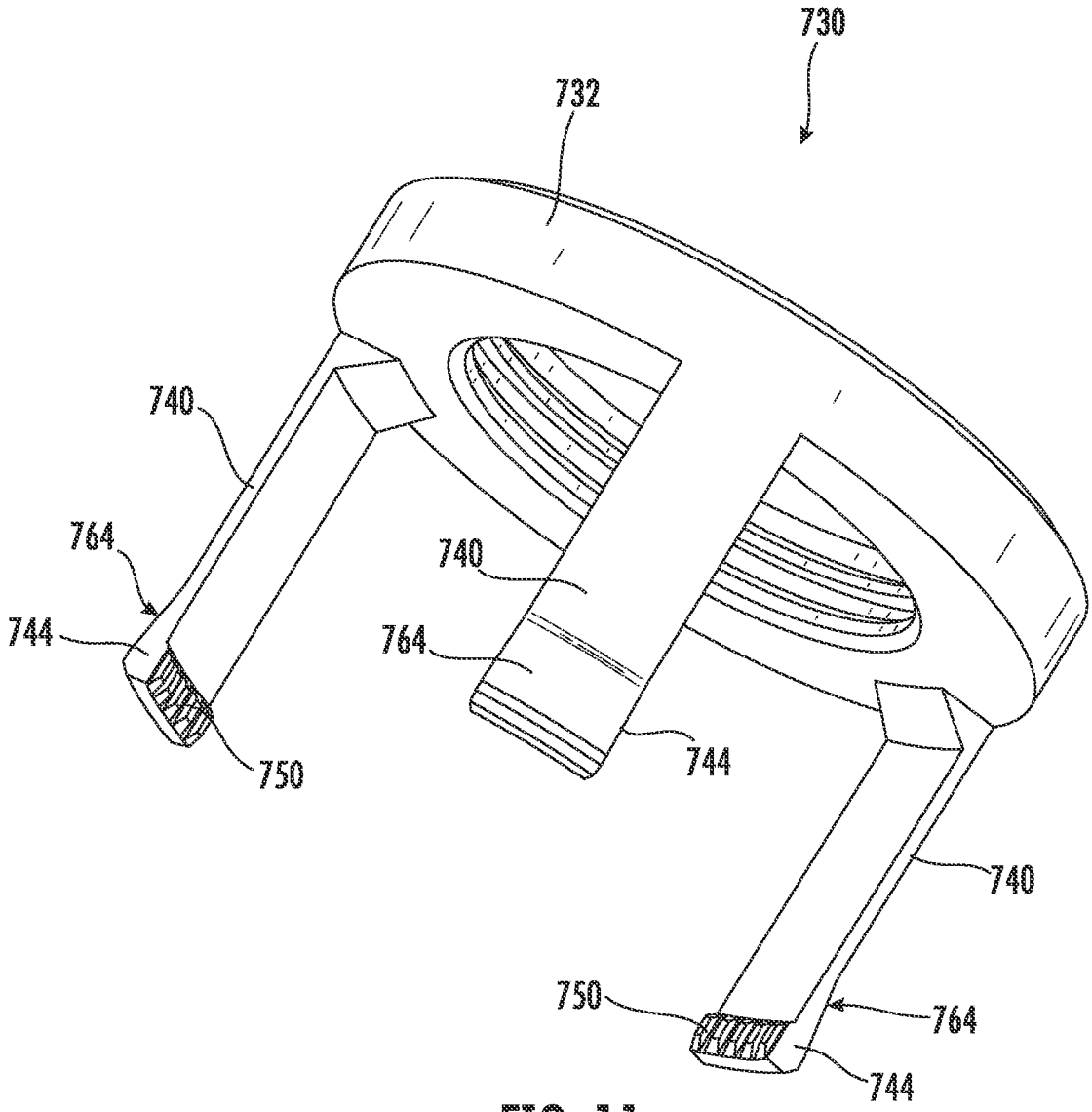
FIG. 11 is a pictorial view of a gripper element of the clutch of the adjustment knob of FIG. 7.
Figure 12:
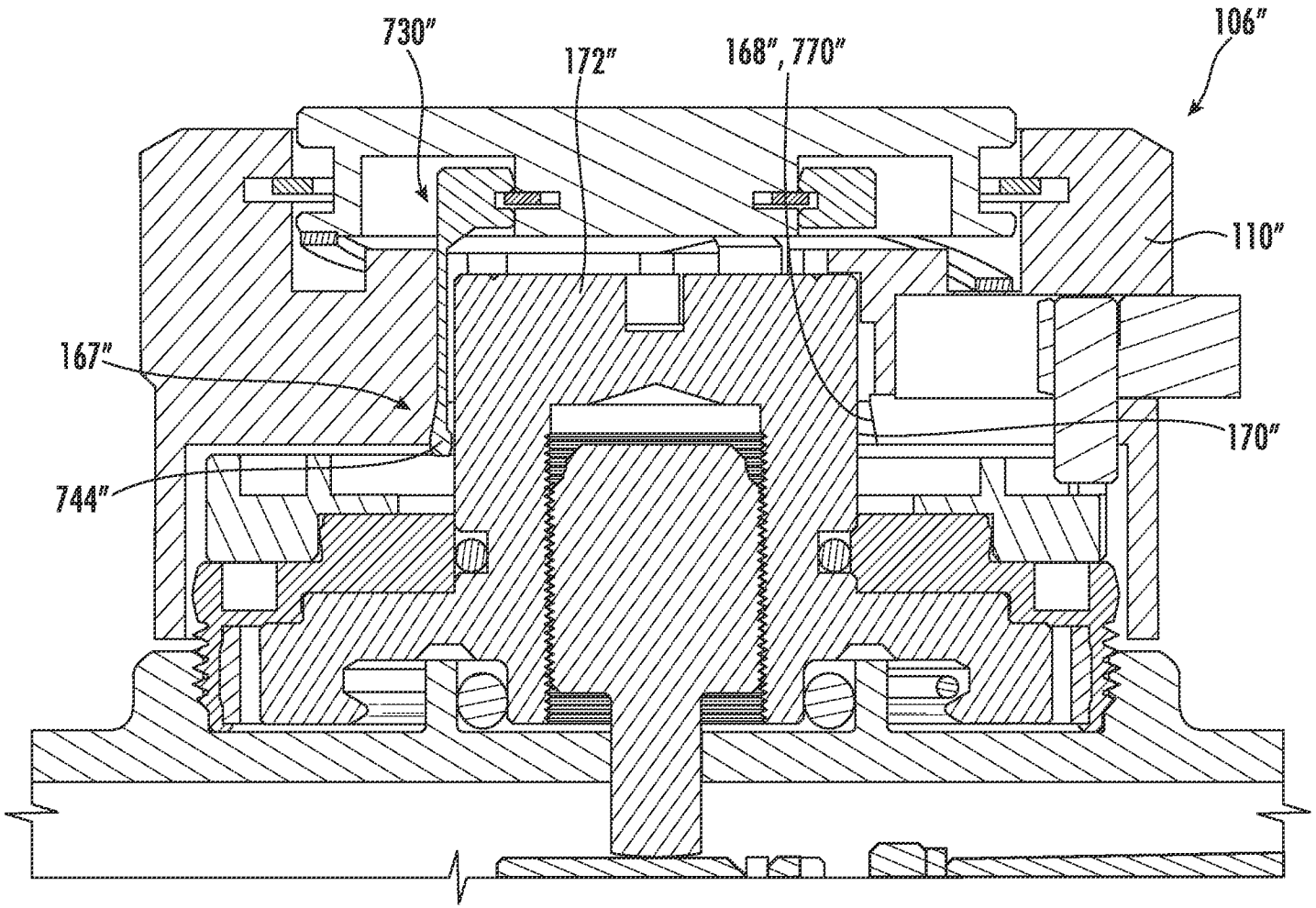
FIG. 12 is a cross-section view showing an adjustment knob according to a third embodiment.
Figure 13:
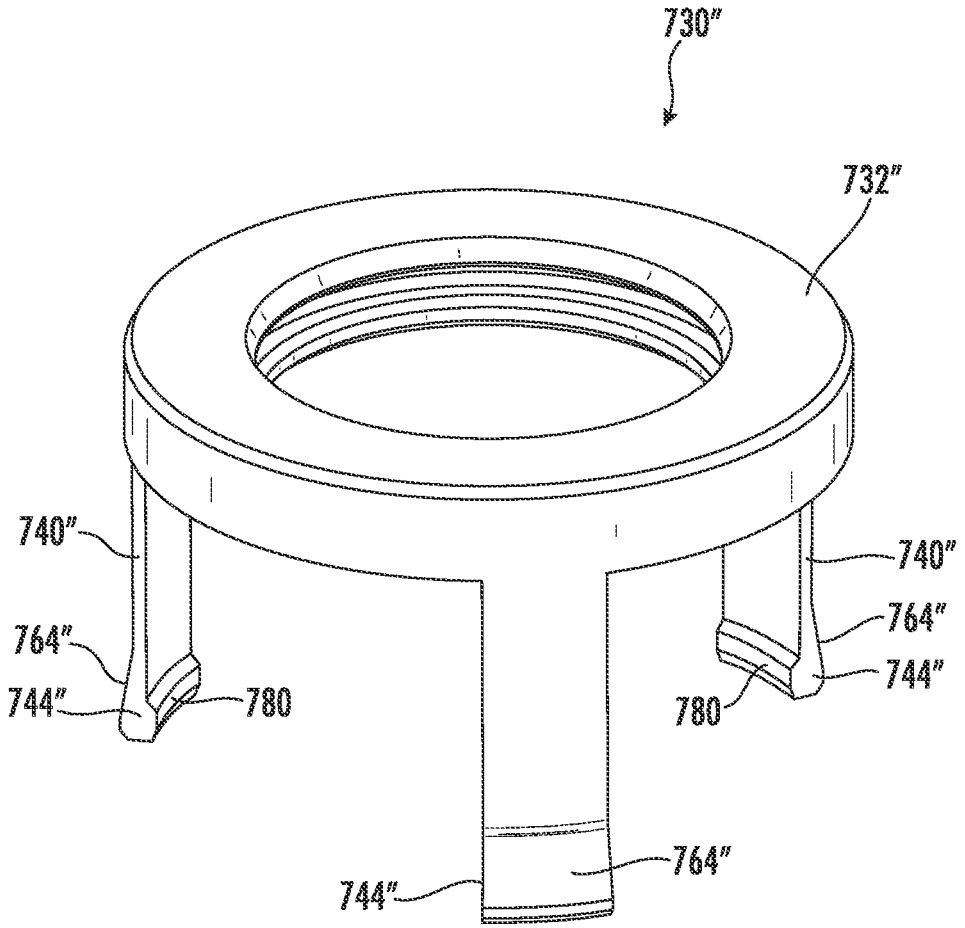
FIG. 13 is a pictorial view of a gripper element of a clutch of the adjustment knob of FIG. 12.

FIGS. 7-11 illustrate an adjustment knob 106' according to another embodiment, and FIGS. 12-13 illustrate an adjustment knob 106" according to yet another embodiment. In FIGS. 7-13, parts of adjustment knobs 106' and 106" that are identical, very similar, and/or functionally equivalent to parts having the same name in the embodiments of FIGS. 1-6 are identified by the same reference numeral followed by a prime symbol(') in the case of the embodiment of FIGS. 7-11, or a double prime symbol (") in the case of the embodiment of FIGS. 12-13, and may not be otherwise described or discussed herein. For example, a guideway ring 130' of a locking mechanism 123' of adjustment knob 106' is identical to guideway ring 130 illustrated in FIGS. 2, 3 and 5, operates in the same manner, and is not otherwise discussed herein.

Figure 7:
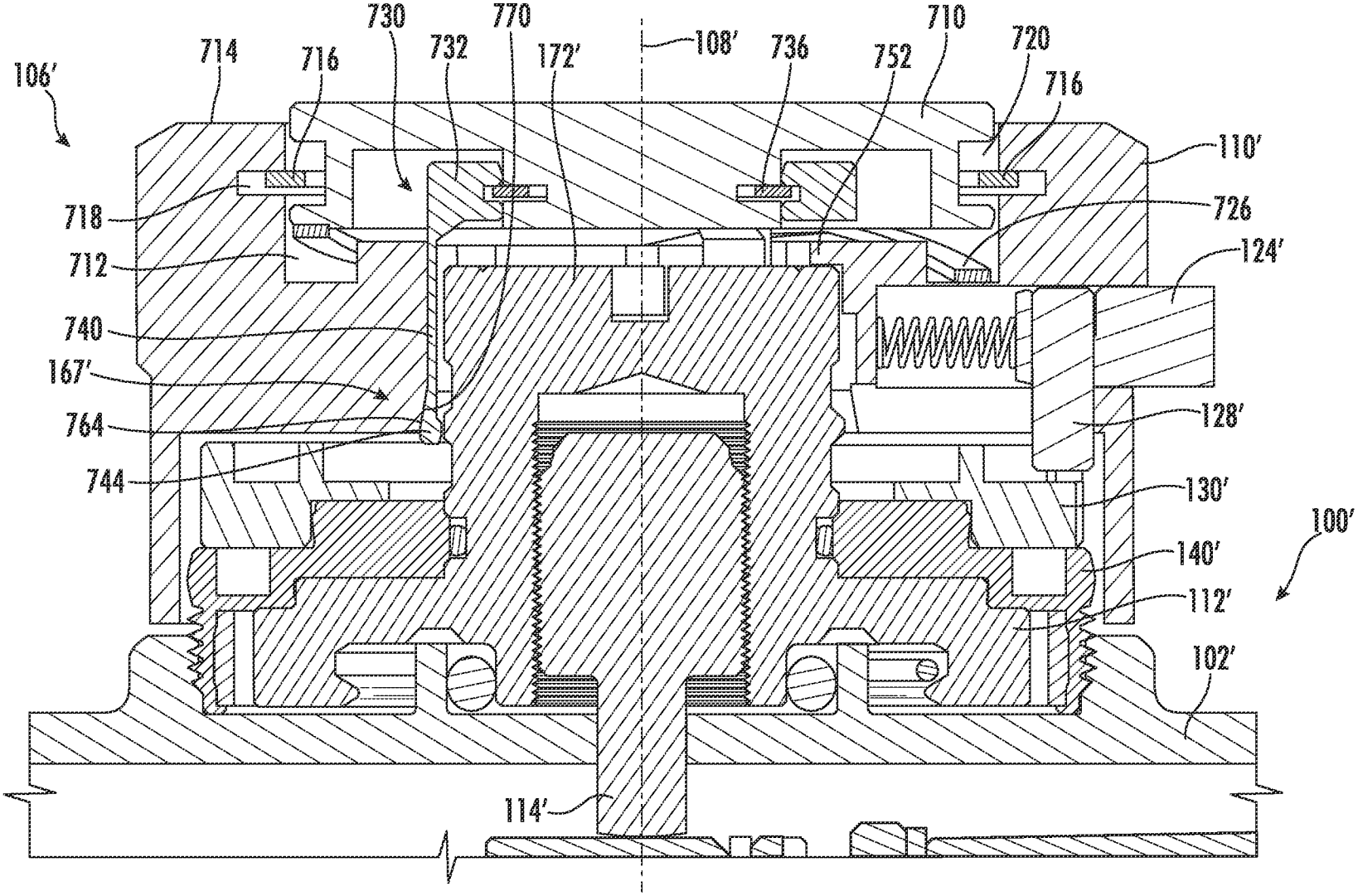
FIG. 7 is a cross-section view showing an adjustment knob according to a second embodiment, showing a clutch of the adjustment knob in an engaged position.
Figure 8:
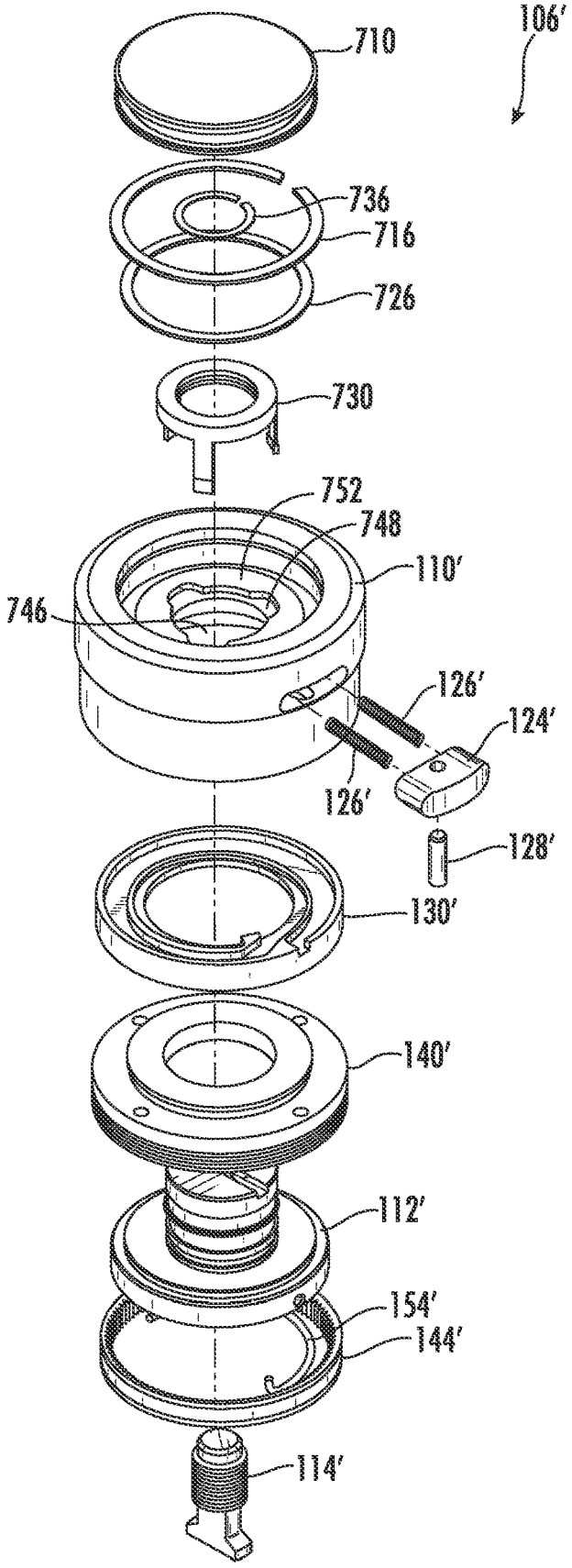
FIG. 8 is an exploded view of the adjustment knob of FIG. 7.
Figure 9:
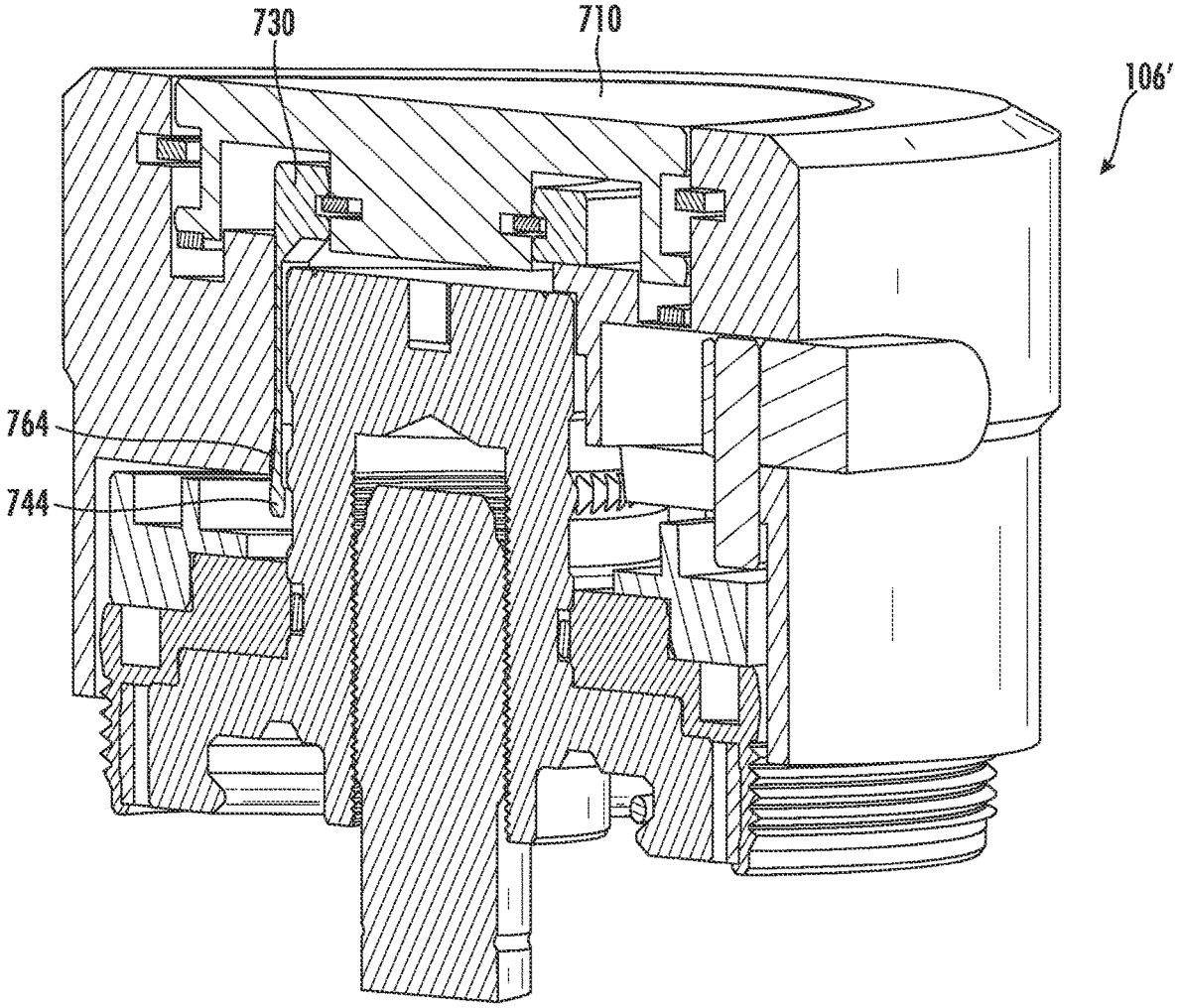
FIG. 9 is an oblique section view of the adjustment knob of FIG. 7, showing a clutch of the adjustment knob in a disengaged position.
Figure 10:
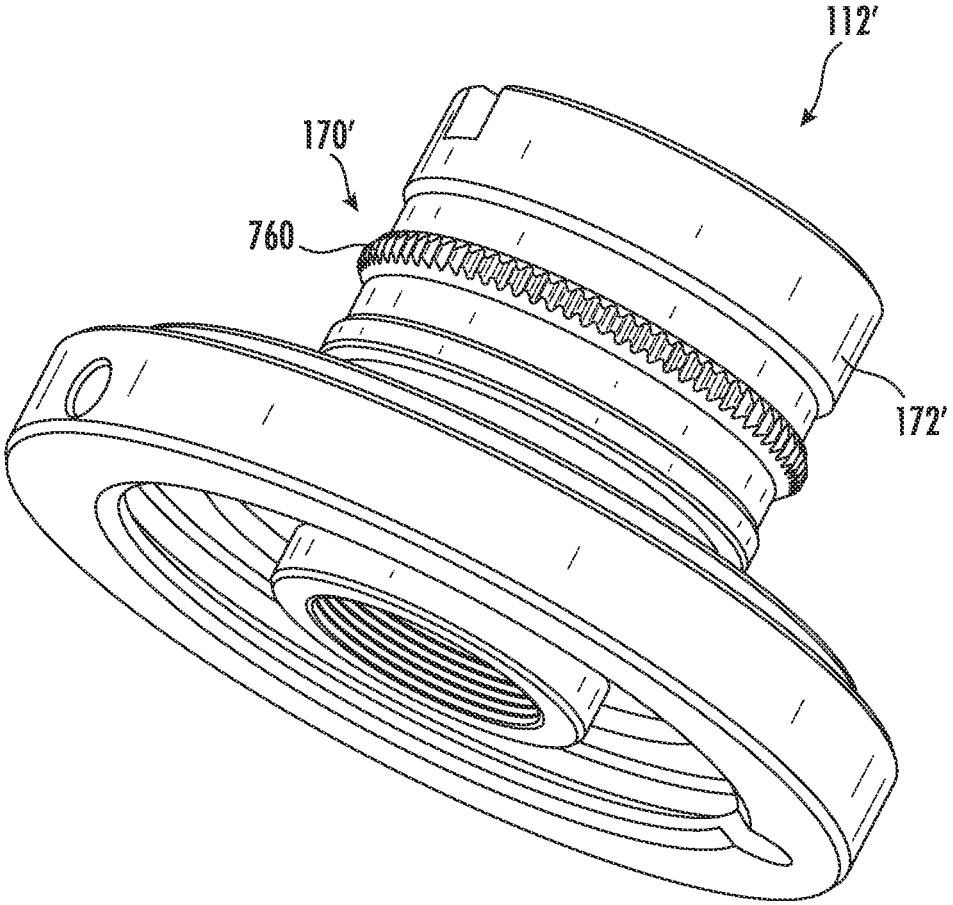
FIG. 10 is a pictorial view of a rotating member of the adjustment knob of FIG. 7.

FIG. 7 is a cross-sectional view of adjustment knob 106' mounted on a riflescope 100' with a clutch 167' (described below) of adjustment knob 106' shown in an engaged position. FIG. 8 is an exploded view of adjustment knob 106'. And FIG. 9 is an oblique section view of adjustment knob 106' with its clutch 167' illustrated in a disengaged position. With reference to FIGS. 7-9, clutch 167' is a push-button style clutch that is actuated by depressing a clutch release button 710 along the axis of rotation 108'. Clutch release button 710 is carried by dial 110' in a counterbore 712 formed in an axial outward end 714 of dial 11O' and is accessible from outside of dial 11O' at the axial outward end 714. Clutch release button 710 is retained on dial 11O' by a retainer ring 716 that is fitted into a groove 718 circumscribing counterbore 712 near axial outward end 714. Retainer ring 716 is received in a circumferential channel 720 in clutch release button 710 that is sized to allow a range of axial movement of clutch release button 710 along axis of rotation 08'. In an alternative embodiment (not illustrated), the retainer ring 716 may be carried in a narrower slot on clutch release button 710 and the groove 718 may be wider to allow retainer ring 716 to move axially therein. Other structures and devices for retaining button 710 on dial 11O' may also be utilized. A wave spring 726 is positioned in counterbore 712 between dial 11O' and clutch release button 710 to bias clutch release button 710 axially outwardly away from housing 102' of riflescope 100' so as to urge clutch 167' toward the engaged position. Clutch release button 710 is illustrated as being relatively large and extending beyond dial 11O' when clutch 167' is in the engaged position, but to prevent accidental release of clutch 167' the clutch release button 710 may alternatively be made smaller and/or sit flush or recessed relative to outward end 714 of dial 11O' when clutch 167' is in the engaged position.

A gripper 730 of clutch 167' is attached to clutch release button 710 and extends axially away from an underside of clutch release button 710 toward housing 102'. Gripper 730, which is best illustrated in FIG. 11, includes a mounting ring portion 732 that is coupled to clutch release button 710 via a snap ring 736, and one or more resilient arms 740 extending away from mounting ring portion 732 toward housing 102'. A wedge-shaped gripper shoe 744 is provided near a terminal distal end of each resilient arm 740. In the embodiment illustrated, gripper 730 includes a balanced arrangement of three arms 740 each terminating in a wedge-shaped gripper shoe 744. Each of the arms 740 may extend through bore 746 (FIG. 8) of dial 11O' and are received in a lobe 748 of an opening formed in a shoulder portion 752 of dial 11O' at the outer end of bore 746. The entirety of gripper 730, including mounting ring portion 732, arms 740, and gripper shoes 744, are preferably formed together in a unitary one-piece construction, such as by molding or by machining from a solid block of metal or other material.

With reference to FIG. 11, each of the gripper shoes 744 may include one or more gripper splines 750, or another type of high-friction surface, on an inner face thereof. Gripper splines 750 face toward and engage a spline ring 760 (FIG. 10) or other rotating member clutch surface 170' of rotating member 112' when clutch 167' is in the engaged condition/position. An outer surface 764 of each gripper shoe 744 on an opposite side of gripper shoe 744 from gripper splines 750 is shaped to wedge into a conical surface 770 or chamfer circumscribing an axially-inner opening of bore 746 (FIG. 8) and forming a dial clutch surface thereof. Outer surface 764 may be smooth (as illustrated) to facilitate smooth actuation of clutch 167', or may textured. As illustrated in FIGS. 7-10, spline ring 760 circumscribes hub 172' of rotating member 112' and gripper splines 750 are formed on a radially-inner surface of each of gripper shoes 744 and facing spline ring 760. However, in an alternative embodiment the gripper splines 750 may be formed on the opposite sides of gripper shoes 744 and spline ring 760 (or other high-friction surface) may circumscribe the axially-inner opening of bore 746, which may or may not be conical or chamfered. In such alternative embodiments, the radially-inner surface of each gripper shoe 744 may be smooth or textured, and optionally inclined or wedge-shaped relative to arms 740, so as to wedge into and grip a complementary rotating member clutch surface on hub 172'.

FIG. 9 illustrates adjustment knob 106' with clutch release button 710 depressed to move gripper 730 axially inward to a disengaged position whereat clutch 167' is disengaged so as to allow dial 11O' to be rotated relative to rotating member 112' for zeroing the adjustment knob 106' without changing the elevation or other setting of riflescope 100'.

FIGS. 12 and 13 illustrate an alternative embodiment of an adjustment knob 106" including a push-button style clutch 167" similar to the push-button clutch 167' of FIGS. 7-11, but in which gripper shoes 744" lack splines on either side. Gripper shoes 744" may be smooth or roughened. The inner gripping surface 780 of gripper shoes 744" may be raised to provide optimal engagement or gripping with rotating member clutch surface 170". Similarly, the embodiment of FIGS. 12 and 13, omits splines from the dial clutch surface 168" and rotating member clutch surface 170". Although rotating member clutch surface 170" is illustrated as merely being a cylindrical side surface of hub 172", the rotating member clutch surface 170" may be roughened to improve grip, or may include a ridge or detent (not illustrated) to improve grip and retention when clutch 167" is engaged.

In accordance with a method of use of an aiming device, an adjustment knob 106 of the aiming device of the kind including a dial and a rotating member rotatable about an axis of rotation 108 to change a setting of the aiming device, is zeroed following initially sighting-in the aiming device. The process of sighting-in an aiming device such as a riflescope, is well known, and typically involves shooting a weapon to which the aiming device is attached and observing deviation of the point of impact of the bullet or other projectile on a target at a known range, such as 100 yards, or 200 yards, or 100 meters (m), or 200 m. The deviation of the point of impact relative to the point of aim of the riflescope or aiming device indicates how much adjustment must be made to the aiming device—in terms of elevation (vertical) adjustment and windage (lateral) adjustment—in order for the scope to be "sighted-in" at that range. The step of "sighted-in" then involves releasing a locking mechanism 123 of the adjustment knob, for example by manually depressing a lock release button 124 located on the dial 110 or by otherwise moving a lock release 125 relative to the dial 110 and the rotating member 112; and, while the locking mechanism 123 is released, rotating the dial 110, whereby the rotating member 112 co-rotates with the dial 110 to adjust an aim of the aiming device, until the aiming device is accurately targeting a point of impact of a firearm or other weapon (not illustrated) to which the aiming device is attached. Once the aiming device has been sighted-in, the method next involves disengaging a clutch 167 of the adjustment knob 106 that selectively couples the dial 110 to the rotating member 112; and, while the clutch 167 is disengaged, rotating a dial 110 of the adjustment knob 106 about the axis of rotation 108, relative to the rotating member 112, until the dial 110 is at its zero position, then engaging the clutch 167 to couple the dial 110 to the rotating member 112 for co-rotation therewith about the axis of rotation 108 for adjusting the aim of the aiming device. In some embodiments the lock release button 124 is located on a side of the dial 110 and releasing the lock mechanism 123 includes manually depressing the button 124 in a radial direction toward the axis of rotation 108. In some embodiments, disengaging the clutch 167 may involve moving at least a portion of the dial 110 axially relative to the rotating member 112.

If sighting-in requires a downward adjustment of the aiming device from its locked position, the method may further include prior to completing the sighting-in process, releasing the locking mechanism 123 and adjusting the adjustment mechanism 106 in a positive direction to clear a zero locked position of the locking mechanism 123, then disengaging the clutch and rotating the dial 110 in the same direction (positive direction) relative to the rotating member 112 while the clutch 167 is disengaged, and then re-engaging the clutch 167 after rotating the dial 110 relative to the rotating member 112. Thereafter a shot is taken with the weapon and the sight adjusted until it is sighted-in, and the remainder of the method described above is then completed to zero the dial.

It will be apparent to those having skill in the art that many changes may be made to the details of the above-described embodiments without departing from the underlying principles of the invention. The scope of the present invention should, therefore, be determined only by the following claims.

The invention claimed is:

1. In a sighting device, an adjustment knob having a plurality of modes of operation including a first mode of operation and a second mode of operation, wherein the adjustment knob is user-zeroable in the second mode of operation, the adjustment knob comprising:

a rotating member rotatable about an axis of rotation to drive movement of one or more optical elements of the sighting device;

a dial or dial assembly around the rotating member, the dial or dial assembly to co-rotate with the rotating member, in the first mode of operation;

wherein one of the rotating member and the dial or dial assembly includes a first surface with one or more engagement features and the other of the rotating member and the dial or the dial assembly includes a second surface, wherein the first and second surfaces are aligned in the first mode of operation and non-aligned in the second mode of operation;

the dial or dial assembly to rotate relative to the rotating member for zeroing the adjustment knob, in the second mode of operation; and a locking mechanism that prevents the rotating member and dial or dial assembly from rotating relative to the sighting device when the locking mechanism is locked, the locking mechanism including a lock release movable relative to the rotating member and the dial or dial assembly to release the locking mechanism and allow the rotating member and the dial or dial assembly to be co-rotated.

2. The sighting device of claim 1, wherein the lock release is accessible from outside of the dial or dial assembly.

3. The sighting device of claim 1, wherein the lock release is carried by the dial or dial assembly for rotation therewith about the axis of rotation.

4. The sighting device of claim 3, wherein the lock release includes a user interface on a side of the dial or dial assembly, the user interface to move in a radial direction toward the axis of rotation to release the locking mechanism.

5. The sighting device of claim 1, wherein the one of the first and second surfaces is movable relative to the other of the first and second surfaces by moving the dial or at least one part of the dial axially relative to the rotating member.

6. The sighting device of claim 5, wherein the one of the first and second surfaces is movable relative to the other of the first and second surfaces by moving a user interface of the dial or dial assembly axially relative to the rotating member.

7. The sighting device of claim 1, wherein the one or more engagement features are defined by a spline ring formed on one or both of the rotating member and the dial or dial assembly.

8. The sighting device of claim 1, wherein the first and second surfaces are centered on the axis of rotation, wherein one of the first and second surfaces defines a male spline and the other of the first and second surfaces defines a female spline.

9. The sighting device of claim 8, wherein the first and second surfaces are selectively non-alignable through movement of the dial or at least one part of the dial assembly axially between an engaged position at which the male and female splines are engaged, and a disengaged position at which the male and female splines are disengaged.

10. The sighting device of claim 1, wherein the dial or dial assembly includes a gripper, wherein one of the first and second surfaces is defined by the gripper and the other surface of the first and second surfaces is defined by the rotating member.

11. The sighting device of claim 10, wherein the first and second surfaces are selectively non-alignable by moving the gripper axially away from a location on the rotating member.

12. The sighting device of claim 11, wherein the gripper includes a wedge that is moved away from the location on the rotating member by actuating a button or other user interface.

13. The sighting device of claim 1, further comprising a retainer that inhibits the dial or dial assembly from being detached from the rotating member.

14. The sighting device of claim 13, wherein the retainer includes a spring snap ring.

15. The sighting device of claim 13, further comprising a disengagement groove and an engagement groove formed in one of the rotating member and the dial or dial assembly, the disengagement groove axially spaced apart from the engagement groove; and the retainer is carried by the other of the rotating member and the dial or dial assembly for movement along the axis of rotation between the engagement groove and the disengagement groove.

16. The sighting device of claim 15, wherein the first and second surfaces are aligned when the retainer is in the engagement groove, the engagement groove is deeper than the disengagement groove, a slope is formed between the disengagement groove and the engagement groove, the retainer to ride over the slope when moving between the grooves.

17. The sighting device of claim 1, wherein the locking mechanism further includes a guideway fixed relative to a housing of the sighting device, the guideway cooperating with the lock release to lock and unlock the locking mechanism.

18. The sighting device of claim 17, wherein the lock release includes a button or other user interface carried by the dial or dial assembly for rotation therewith about the axis of rotation and a protrusion extending from the button or other user interface which rides along the guideway as the dial or dial assembly is rotated, the guideway includes a notch into which the protrusion is seated to lock the locking mechanism, and the button or other user interface is movable in a radial direction to move the protrusion out of the notch and release the locking mechanism.

19. The sighting device of claim 1, wherein the locking mechanism locks when the dial or dial assembly is rotated to a zero location of the dial or dial assembly.

20. In an optical device, an adjustment knob having a plurality of modes of operation including a first mode of operation and a second mode of operation, wherein the adjustment knob is user-zeroable in the second mode of operation, the adjustment knob comprising:

a rotating member rotatable about an axis of rotation to drive movement of one or more optical elements of the sighting device;

a dial or dial assembly around the rotating member, the dial or dial assembly to co-rotate with the rotating member, in the first mode of operation;

wherein one of the rotating member and the dial or dial assembly includes a first surface with one or more engagement features and the other of the rotating member and the dial or the dial assembly includes a second surface, wherein the first and second surfaces are aligned in the first mode of operation and non-aligned in the second mode of operation;

the dial or dial assembly to rotate relative to the rotating member for zeroing the adjustment knob, in the second mode of operation; and a locking mechanism that prevents the rotating member and dial or dial assembly from rotating relative to the sighting device when the locking mechanism is locked, the locking mechanism including a lock release movable relative to the rotating member and the dial or dial assembly to release the locking mechanism and allow the rotating member and the dial or dial assembly to be co-rotate.

* * * * *